US007520935B2

(12) United States Patent
Fellinger

(10) Patent No.: US 7,520,935 B2
(45) Date of Patent: Apr. 21, 2009

(54) SPRAYED INSULATION APPLICATION SYSTEM HAVING VARIABLY LOCATABLE COMPONENTS

(75) Inventor: Thomas J. Fellinger, Littleton, CO (US)

(73) Assignee: Johns Manville, Denver, CO (US)

( * ) Notice: Subject to any disclaimer, the term of this patent is extended or adjusted under 35 U.S.C. 154(b) by 409 days.

(21) Appl. No.: 11/314,429

(22) Filed: Dec. 21, 2005

(65) Prior Publication Data

US 2007/0151201 A1 Jul. 5, 2007

(51) Int. Cl.
*B05C 19/00* (2006.01)
*B05B 13/06* (2006.01)
*B60P 1/60* (2006.01)

(52) U.S. Cl. ..... 118/308; 118/317; 406/42

(58) Field of Classification Search ..... 118/308, 118/317, 306, 323; 427/476, 180, 230, 236, 427/427.1; 406/42, 139, 135, 145, 146, 32, 406/164, 65, 52; 52/742.13
See application file for complete search history.

(56) References Cited

U.S. PATENT DOCUMENTS 4,504,525 A * 3/1985 Bellafiore ..... 427/230
5,403,128 A * 4/1995 Thomas ..... 406/39
5,556,237 A * 9/1996 Rexius ..... 406/32
6,045,298 A * 4/2000 Lytle ..... 406/48

* cited by examiner

*Primary Examiner*—Yewebdar T Tadesse
(74) *Attorney, Agent, or Firm*—Robert D. Touslee

(57) ABSTRACT

This invention relates generally to sprayed insulation application systems, and more particularly to systems that utilizes a sole power source to directly or indirectly drive the system's multiple components independent of the location of a power-take-off. In one embodiment of the invention, the system utilizing a sole power source comprises at least one power-take-off operably associated with the power source. An insulation blower and a hydraulic drive are operably associated with the at least one power-take-off. An electrical generator and a vacuum fan are operably associated with the hydraulic drive, with at least one control regulating the operable association of the generator and the vacuum fan with the hydraulic drive. In another embodiment of the invention, the hydraulic drive is operably associated with the power-take-off, with the generator, vacuum fan and insulation blower operably associated with the hydraulic drive. The electrical generator, driven by the generator hydraulic motor in fluid communication with the hydraulic drive, preferably provides electrical energy to the scrubber, and to the at least one liquid heater and/or the electrically powered lift, if utilized within the system, via electrical conduits. A pump may be optionally driven by the hydraulic drive or energized by the generator.

26 Claims, 9 Drawing Sheets

SPRAYED INSULATION APPLICATION SYSTEM HAVING VARIABLY LOCATABLE COMPONENTS

TECHNICAL FIELD OF THE INVENTION

This invention relates generally to sprayed insulation application systems, and more particularly to systems that utilize a sole power source to directly or indirectly drive the system's multiple components independent of the location of a power-take-off.

BACKGROUND OF THE INVENTION

Sprayed insulation is commonly used in the construction industry for insulating the open cavities of building walls, floors, ceilings, attics and other areas. Insulation materials, such as loose fiberglass, rock wool, mineral wool, fibrous plastic, cellulose, ceramic fiber, etc. that is combined with an adhesive or water, are sprayed into such open cavities to reduce the rate of heat loss or gain there-though. The adhesive properties of the insulation mixture, comprising the insulation combined with adhesive or water, allow it to adhere to vertical or overhanging surfaces, thus allowing for an application of insulation prior to the installation of wallboard and similar cavity enclosing materials.

Various systems have been devised for the application of spayed insulation and adhesive mixtures into open cavities. Such systems typically utilize a loose insulation blower that draws loose insulation out of a hopper and pneumatically conveys it through a hose and out of the end of an applicator nozzle. The adhesive that is mixed with the insulation is preferably a liquid adhesive that is sprayed as a mist onto the airborne insulation as it leaves the outlet end of the applicator nozzle. The water may also be sprayed onto the airborne insulation when the insulation includes a dry adhesive material, with the water thereafter activating the adhesive properties of the material. The liquid adhesive or water is typically pumped with a liquid pump from a reservoir, through a hose, and out through one or more spray tips located proximal to the end of the applicator nozzle. In cold climates, the liquid adhesive or water is heated within the reservoir to a desired working temperature with one or more electric heaters that receive energy from either the 110 V electrical outlet or an electrical generator.

In applying sprayed insulation to open cavities, installers typically manually hold the outlet end of the applicator nozzle towards the open cavity. The installer then sprays the insulation and adhesive mixture into the cavity until the cavity is filled. To ensure that the cavity is completely filled, an installer typically sprays an excess amount of mixture into the cavity such that an excess quantity of sprayed insulation has accumulated beyond an opening of the cavity defined by the cavity's confining boundaries, i.e. beyond the opening of a wall cavity defined by wall studs. The excess quantity of insulation is then removed or "scrubbed off," utilizing a rotary scrubber, to define a boundary of the sprayed insulation lying substantially planar at the cavity's opening. The scrubber preferably comprises a rotary, cylindrical brush or textured wheel preferably driven by an electric motor that receives energy from either a standard 110 V electrical outlet or an electrical generator. The cylindrical brush or wheel spans the width of the wall cavity and rotates to remove the excess insulation material there-from.

A separate vacuum system is typically utilized to gather the excess insulation that is scrubbed-off or removed from the cavity's opening. In utilizing such a vacuum system, excess or scrubbed-off insulation is gathered or swept into a localized area. The gathered excess insulation is then drawn into the end of a vacuum nozzle typically held by an installer. A negative pressure vacuum fan then draws the excess material into the vacuum inlet and through a vacuum hose, and thereafter deposits the material into a bin or other container. A lift may optionally be utilized to elevate the applicator's nozzle, scrubber and vacuum inlet when applying sprayed insulation in elevated areas. The lift may be electrically powered, utilizing a driven cable assembly, one or more machine gears or pneumatic or hydraulic actuators to ascend and descend the lift.

Each of the foregoing components of the sprayed insulation application system, namely, the insulation blower, liquid pump, vacuum fan and electrical generator for providing electrical energy to the heater, scrubber, electrically powered lift and/or other electrical devices, are driven mechanisms that receive rotational energy from a power source. Thus, many sprayed insulation application systems present in the art utilize one or more gasoline engines to provide the requisite rotational energy to these components. For example, one gasoline engine may power the insulation blower while separate gasoline engines respectively power the vacuum fan and the electrical generator.

Several disadvantages, however, are associated with the use of use of gasoline engines to power the various components of a sprayed insulation application system. Because many of the components of such systems are portable to facilitate moving the equipment between insulation application job sites, gasoline must either be provided at a given job site or hauled to and from the job site to fuel the engines, resulting in added construction costs. Also, because each gasoline engine produces exhaust fumes, the location of a given engine-powered component at a job site may create a safety hazard if the component is located in an enclosed work space where ventilation is limited.

For example, because the application of a sprayed insulation system typically occurs within an enclosed building, the location of a gasoline engine-powered component (i.e. an electrical generator) within the building may create a safety hazard for construction workers located therein due to the accumulation of exhaust fumes. Furthermore, because the multiple components of a given sprayed insulation application system are often located within the interior of a panel truck box or within the interior of a trailer to facilitate the system's portability, the use of gasoline engines within the confined space of the box or trailer is undesirable as well due to the accumulation of the resultant exhaust fumes.

In an effort to minimize the use of individual gasoline engines to power the various components of a sprayed insulation application system, many application systems present in the art utilize a sole power source and power-take-off to provide the rotational energy to one or more of the system's components. The power-take-off ("PTO"), well known in the art, generally comprises a series of gear, shafts, belts and clutches that draws power preferably from a vehicle's transmission to provide rotational energy to other components. Thus, for the various components of a sprayed insulation application system located in the box of a given truck, the truck's PTO may provide rotational energy to one or more of the system's components, thus utilizing the truck's engine as the sole power source and minimizing the use of individual gasoline engines to drive the components.

Several disadvantages, however, are associated with using a truck's PTO to power the various components of a sprayed insulation application system. A PTO is typically located proximal to a vehicle's transmission, with the PTO's output shaft typically about centrally located below the truck's bed. To allow the output shaft of the PTO to drive the various components of a sprayed insulation application system, their location must be proximal to that of the output shaft, thus limiting the variability of the location of each component.

For example, because the output shaft of a truck's PTO is typically about centrally located below the bed of the truck's storage box, any component receiving rotational energy there-from must also be located about centrally on the bed within the truck's box to ensure its proximity with the shaft. However, the central location of one or more components (i.e. the electrical generator, liquid pump and/or vacuum fan) about the main drive shaft of a truck may not be desirable where such components are preferably located remotely of the box of the truck during the insulation application process (i.e. within the building enclosure receiving the insulation), or where their central location within a truck's box is either impractical or inconvenient.

Thus, what is needed is a sprayed insulation application system that minimizes the use of multiple gasoline engines to drive the various components of the system. The system should allow its components to receive rotational energy from the sole power source (i.e. engine) of a vehicle without requiring the components to be located proximal to the PTO and/or the vehicle's main drive shaft. The present invention fulfills these needs.

SUMMARY OF THE INVENTION

This invention relates generally to sprayed insulation application systems, and more particularly to systems that utilize a sole power source to directly or indirectly drive the system's multiple components independent of the location of a power-take-off. In one embodiment of the invention, the sprayed insulation application system utilizing a sole power source comprises at least one power-take-off operably associated with the power source. An insulation blower and a hydraulic drive are operably associated with the at least one power-take-off. An electrical generator and a vacuum fan are operably associated with the hydraulic drive, with at least one control regulating the operable association of the generator and the vacuum fan with the hydraulic drive. A liquid pump is optionally operably associated with the hydraulic drive and regulated by the at least one control.

In another embodiment of the sprayed insulation application system utilizing a sole power source, the system again comprises the power-take-off operably associated with the power source, with the hydraulic drive operably associated with the power-take-off. The electrical generator, vacuum fan and insulation blower are operably associated with the hydraulic drive, with at least one control regulating the operable association of the generator, the vacuum fan and the insulation blower with the hydraulic drive. The pump is again optionally operably associated with the hydraulic drive and regulated by the at least one control.

Within both embodiments, the generator preferably energizes the scrubber, at least one liquid heater, and the electrically powered lift, if utilized. The pump is optionally energized by the generator instead of having an operable association with the hydraulic drive. Although the generator energizes each of these mechanisms, and optionally the pump, it is understood that one or more of the mechanisms may not be utilized within the system and thus would not be energized by the generator. It is also understood that additional mechanisms may be energized by the generator as well.

Because the sprayed insulation application system is portable and transported to various construction job sites preferably within the box of a truck, the sole power source driving the system preferably comprises the truck's engine. The PTO preferably comprises an output shaft driven by a take-off assembly operably associated with the transmission the engine. The take-off assembly of the PTO selectively draws rotational power from the engine's transmission to transmit it through the output shaft to any desired, driven component.

The insulation blower of the sprayed insulation application system preferably includes sub-components that condition the insulation material and blow it through the hose to its application destination, namely a conditioning unit and a blower fan. The conditioning unit, which conditions the insulation material for the blower fan, preferably comprises at least a feeder, a shredder and a rotary airlock. The feeder, shredder, and rotary airlock are preferably operably associated with one another via a conditioning unit drive train. The conditioning unit drive train allows each of the sub-components of the conditioning unit to be driven by a single source. The blower also includes an insulation blower power train preferably operably connected to the PTO to selectively transmit rotational power from the PTO to either or both the conditioning unit drive train and the blower fan of the blower The hydraulic drive operably associated with the PTO preferably comprises a hydraulic pump well known in the art that utilizes hydraulic fluid to drive the various components of the sprayed insulation application system 5 via a network of hydraulic lines. The connection of the hydraulic lines between the hydraulic drive and the system's components, to include the electrical generator, the vacuum fan and optionally the pump and insulation blower, allows each of these components to be located anywhere independent of the location of the PTO.

In embodiments of the system having the generator and vacuum fan, and optionally the pump driven by the hydraulic drive, the operable association of the generator, vacuum fan and optional pump with the hydraulic drive comprises a generator hydraulic motor, a vacuum fan hydraulic motor and the optional pump hydraulic motor, each in fluid communication with the hydraulic drive. For embodiments of the system also having the insulation blower operably associated with the hydraulic drive along with the optional pump, the operable association of the blower with the hydraulic drive further comprises a conditioning unit hydraulic motor and a blower fan hydraulic motor while the operable association of the optional pump with the hydraulic drive again comprises the pump hydraulic motor. Each hydraulic motor is in fluid communication with the hydraulic drive in addition to the generator and vacuum fan hydraulic motors.

The at least one control regulates the operable association of the generator, the vacuum fan, and optionally the pump and insulation blower with the hydraulic drive. In embodiments of the system having the generator and vacuum fan, and optionally the pump driven by the hydraulic drive, the at least one control preferably comprises a generator valve, a vacuum fan valve and optionally the pump valve respectively regulating the fluid communication between the hydraulic drive and the generator, vacuum fan and optional pump hydraulic motors. For embodiments of the system also having the insulation blower operably associated with the hydraulic drive along with the optional pump, the at least one control further comprises a conditioning unit valve and a blower fan valve, while the at least one control for the optional pump again comprises the pump valve. Each valve respectively regulates the fluid communication between the hydraulic drive and the respective hydraulic motors in addition to those valves regulating the fluid communication between the drive and the other hydraulic motors of the system.

The electrical generator, driven by the generator hydraulic motor in fluid communication with the hydraulic drive, preferably provides electrical energy to the electric scrubber motor of the scrubber and to the at least one liquid heater via electrical conduits. If the pump is not operably associated with the hydraulic drive, the electrical generator also provides electrical energy to an electric pump motor of the pump via the electrical conduit. It is understood that in addition to the foregoing components, the generator may also provide electrical energy to various other components as well, to include various hand tools, an optional electrically driven reciprocator used to move the applicator nozzle in a side-to-side motion during the application process, and or an air compressor, etc.

In use in one embodiment of powering the sprayed insulation application system utilizing a sole power source, the at least one power-take-off is driven by the sole power source, with the insulation blower and the hydraulic drive driven by the at least one power-take-off. The hydraulic drive drives the electrical generator and the vacuum fan by providing a flow of hydraulic fluid to the respective generator and vacuum fan hydraulic motors. If the pump of the system is driven by the hydraulic drive, the drive provides a flow of hydraulic fluid to the pump's hydraulic motor as well. The generator energizes the scrubber, and the at least one liquid heater and/or the electrically powered lift, if utilized within the system. If the pump of the system is associated with the generator and not the hydraulic drive, the pump is energized by the electrical generator as well.

In use in another embodiment of powering the sprayed insulation application system with a sole power source, the power-take-off is again driven by the sole power source, with the hydraulic drive driven by the power-take-off. The hydraulic drive thus drives the electrical generator, the vacuum fan and the insulation blower by providing a flow of hydraulic fluid to the respective generator, vacuum fan, conditioning unit, and blower fan hydraulic motors. Again, if the pump of the system is driven by the hydraulic drive, the drive provides a flow of hydraulic fluid to the pump's hydraulic motor as well. The generator again energizes the scrubber, and the at least one liquid heater and/or the electrically powered lift, if utilized within the system. If the pump of the system is associated with the generator and not the hydraulic drive, the pump is energized by the electrical generator as well.

DESCRIPTION OF THE PREFERRED EMBODIMENTS

Figure 1:
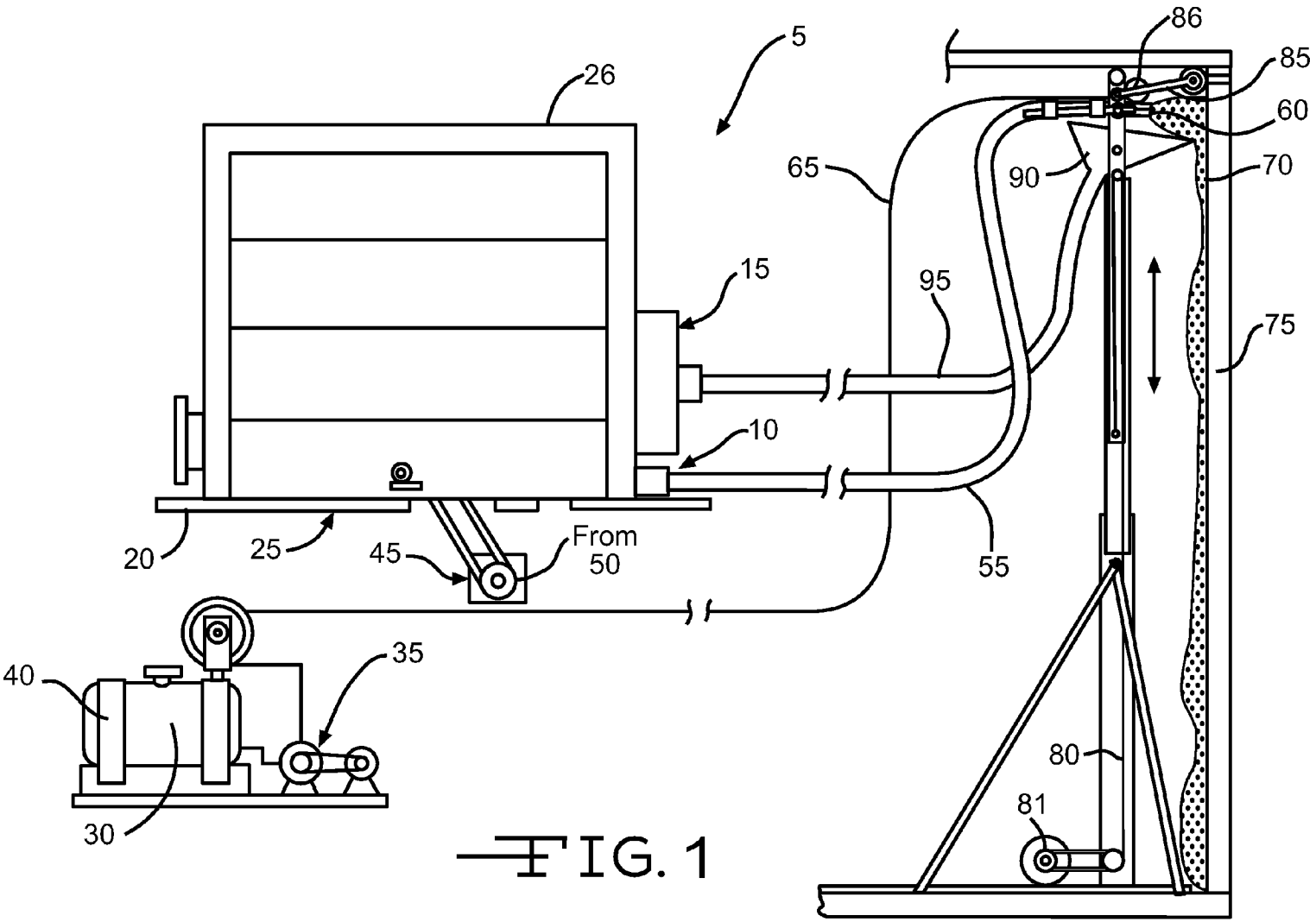
FIG. 1 is a schematic elevation view illustrating the basic components of a sprayed insulation application system that receive power in accordance with the present invention.

This invention relates generally to sprayed insulation application systems, and more particularly to systems that utilize a sole power source to directly or indirectly drive the system's multiple components independent of the location of a power-take-off. Prior to discussing how the sprayed insulation application system is powered in accordance with the present invention, a discussion of the system's powered components is in order. FIG. 1 thus illustrates the basic components of a preferred embodiment of a sprayed insulation application system 5 that is powered in accordance with the present invention.

As illustrated therein, an insulation blower 10 and a vacuum fan 15 are preferably located on the bed 20 of a truck 25 (truck viewed from the rear with the wheels and axle omitted for clarity), preferably within the truck's box 26, while a liquid reservoir 30 and pump 35, for storing and conveying water or a liquid adhesive utilized by the system, are preferably located remotely of the truck. At least one liquid heater 40 may be utilized with the reservoir 30 to maintain the water or liquid adhesive stored therein at a predetermined, optimum working temperature. A power-take-off 45 driven by a sole power source 50 (i.e. the truck's engine, to be further discussed) is located on the truck 25 below the bed 20 for powering the system. The insulation blower 10 conveys loose insulation via an applicator hose 55 to the applicator nozzle 60, where the air-born insulation leaves the nozzle and is mixed with a mist of water (if a dry adhesive is present in the loose insulation) or liquid adhesive provided by the liquid reservoir 30 via the liquid pump 35 and liquid hose 65. The insulation mixture 70 is thus sprayed into the wall cavity 75 where it adheres therein.

Although not required, the applicator nozzle 60 may be mounted to an electrically powered lift 80 located proximal to the wall cavity 75 to enable the applicator nozzle to reach elevated areas of the cavity. An electric motor 81 is preferably utilized to raise and lower the lift 80, with the motor driving a cable assembly (i.e., FIG. 1), a machine gear, or an air compressor or separate hydraulic pump for the operation of pneumatic or hydraulic actuators of the lift. An electrically powered scrubber 85, driven by a scrubber motor 86, is preferably also mounted to the lift 80 above the applicator nozzle 60 to facilitate the removal of any excess sprayed insulation mixture 70 from the cavity 75. A vacuum inlet 90, preferably located on the lift 80 below the nozzle 60 and connected via a vacuum hose 95 to the vacuum fan 15 on the truck, receives the excess insulation mixture 70 that is scrubbed from the wall cavity 75 by the scrubber 85.

Figure 2A:
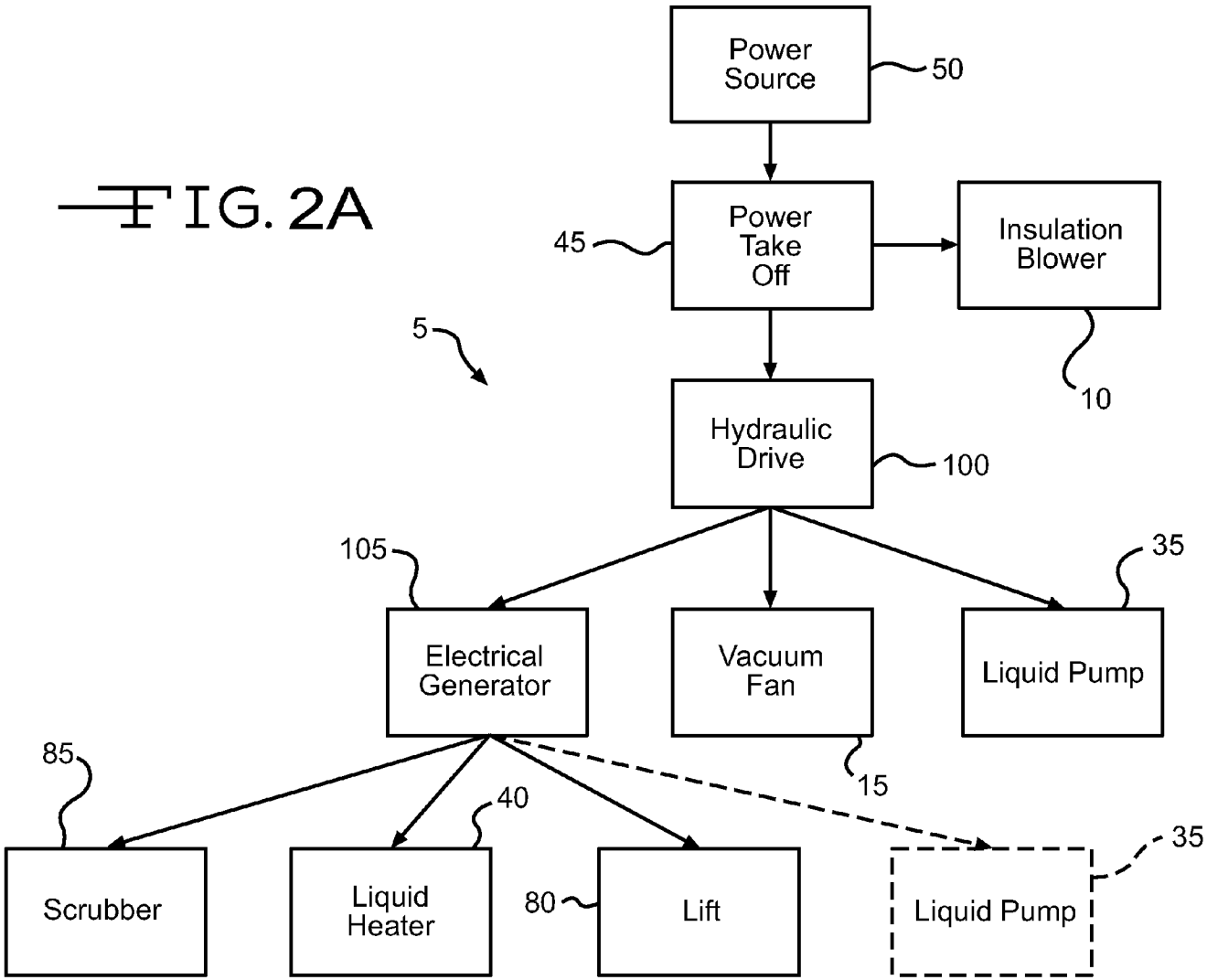
FIG. 2A is a schematic diagram illustrating the relationship of the components powered in accordance with one embodiment of the system.
Figure 2B:
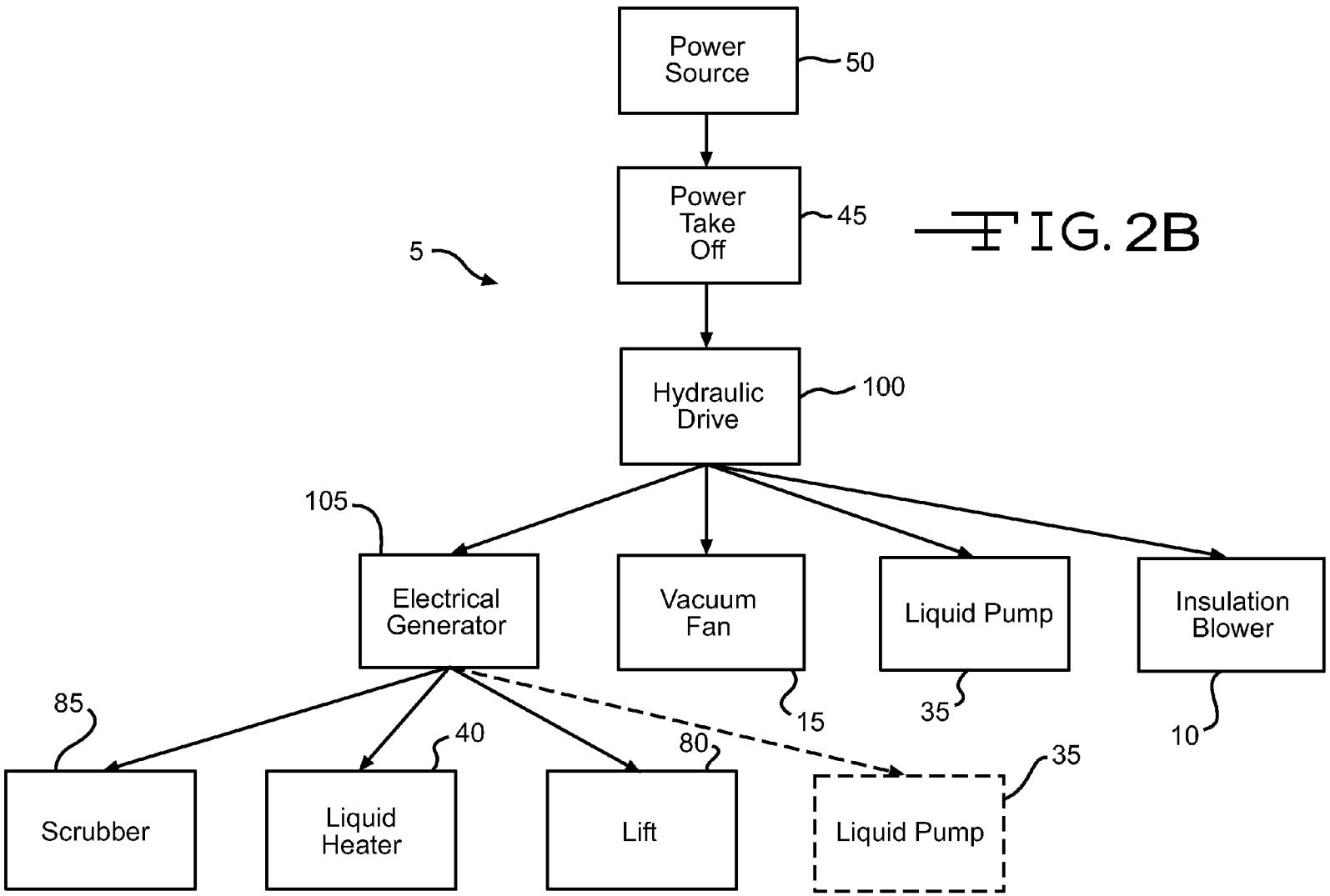
FIG. 2B is a schematic diagram illustrating the relationship of the components powered in accordance with another embodiment of the system.

Turning now to a discussion of how the components of the system are powered in accordance with the present invention, FIGS. 2A and 2B are schematic diagrams illustrating the relationship of the components powered in accordance with alternate embodiments of the system 5. As illustrated in FIG. 2A in one embodiment of the invention, the sprayed insulation application system 5 utilizing a sole power source 50 comprises at least one power-take-off 45 operably associated with the power source 50. The insulation blower 10 and a hydraulic drive 100 are operably associated with the at least one power-take-off 45. An electrical generator 105 and the vacuum fan 15 are operably associated with the hydraulic drive 100, with at least one control 110 (not shown in FIG. 2A, to be discussed further) regulating the operable association of the generator and the vacuum fan with the hydraulic drive. The liquid pump 35 of the reservoir 30 is optionally operably associated with the hydraulic drive 100 and regulated by the at least one control 110.

As illustrated in FIG. 2B in another embodiment of the sprayed insulation application system 5 utilizing a sole power source 50, the system 5 again comprises the power-take-off 45 operably associated with the power source 50, with the hydraulic drive 100 operably associated with the power-take-off 45. The electrical generator 105, vacuum fan 15 and insulation blower 10 are operably associated with the hydraulic drive 100, with at least one control 110 (not shown in FIG. 2B, to be discussed further) regulating the operable association of the generator, the vacuum fan and the insulation blower with the hydraulic drive. The pump 35 is again optionally operably associated with the hydraulic drive 100 and regulated by the at least one control 110.

Within both systems illustrated in FIGS. 2A and 2B, the generator 105 preferably energizes the scrubber 85, at least one liquid heater 40, and the electrically powered lift 80, if utilized. As illustrated in phantom in both figures, the pump 35 is optionally energized by the generator 105 instead of having an operable association with the hydraulic drive 100, to be further discussed. Although FIGS. 2A and 2B illustrate the generator 105 as energizing each of these mechanisms, and optionally the pump, it is understood that one or more of the mechanisms may not be utilized within the system and thus would not be energized by the generator. For example, the liquid heater 40 and/or the electrically powered lift 80 may not be utilized within a given insulation application system if the insulation does not require an application in elevated wall cavities and/or in a cold environment, thus not requiring an energization of these components by the generator. It is also understood that additional mechanisms, such as miscellaneous electrically power hand tools, radios, a reciprocator for reciprocating the applicator nozzle in a side-to-side motion, or an air compressor, etc. may be energized by the generator 105 as well. It is further understood that other variations may also occur within the systems illustrated in both FIGS. 2A and 2B. For example, the lift 80 may be operably associated with the hydraulic drive 100 instead of receiving energy from the electrical generator 105 to raise and lower the lift accordingly.

Figure 3:
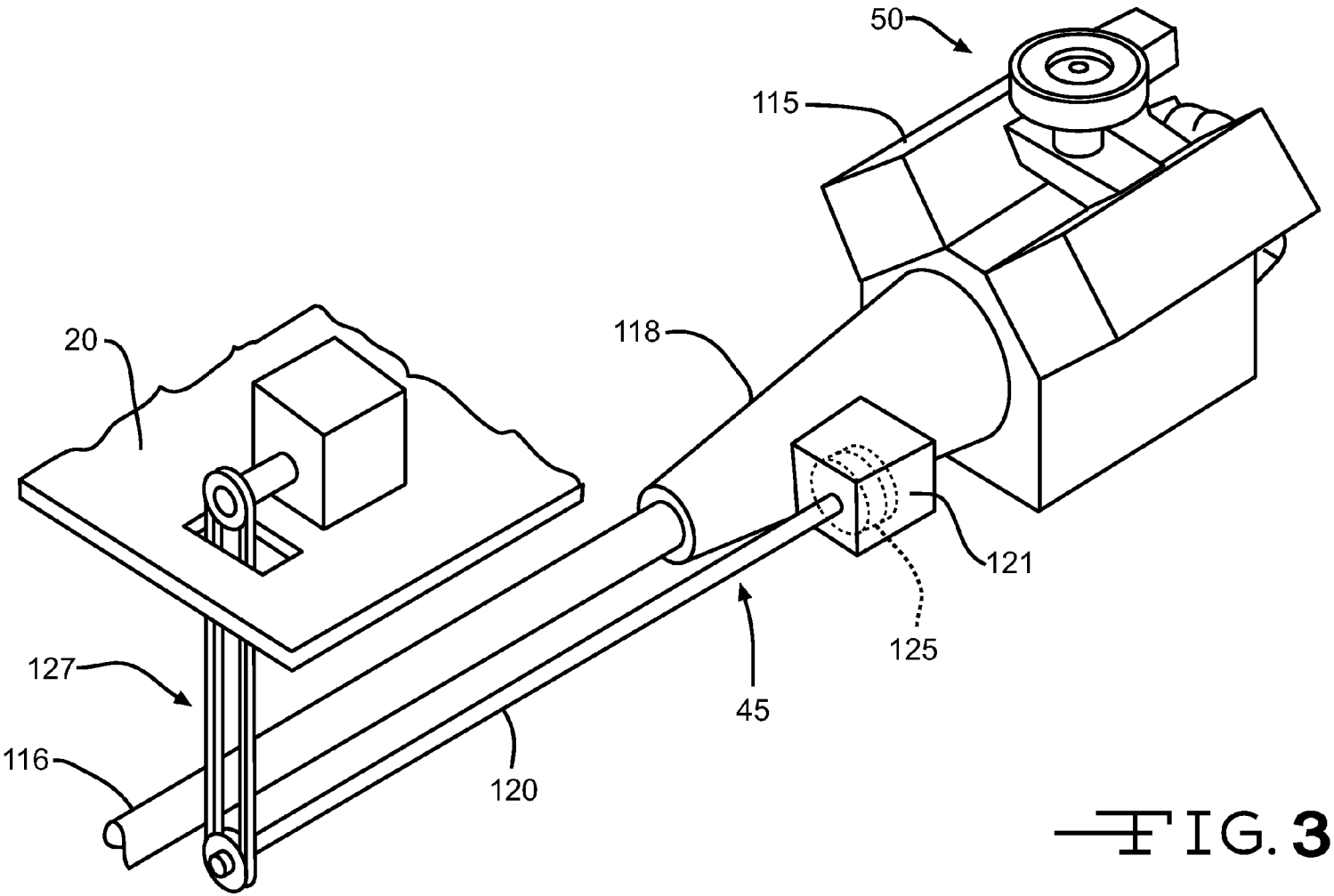
FIG. 3 is a top perspective view of an embodiment of the power source and related components of the system.

Referring to FIG. 3, which is a top perspective view illustrating the sole power source 50 and related components, because the sprayed insulation application system 5 is portable and transported to various construction job sites preferably within the box 26 of the truck 25, the sole power source driving the system preferably comprises the truck's engine 115. The engine 115 may be either gasoline or diesel powered and should have a horsepower capable of driving the power-take-off ("PTO") 45 and all of the components of the sprayed insulation application system 5 driven by the PTO. In the preferred embodiment of the invention, the engine preferably produces a PTO output of at least 42 horsepower.

As is well known in the art, the engine 115 drives a drive shaft 116 operably associated with the truck's differential axle and wheels (not shown) via a transmission 118, with the PTO 45 preferably comprising an output shaft 120 driven by a take-off assembly 121 operably associated with the transmission. The PTO 45 is typically mounted to the truck 25 below the truck's bed 20 proximal to the transmission. As is well known in the art, the take-off assembly 121 of the PTO 45 comprises an assembly of power transmission components, to include belts, chains and/or gears, etc., that selectively draw rotational power from the engine's transmission 118 to transmit it through the output shaft 120 to any desired, driven component. The PTO 45 preferably further comprises a belt and sheave assembly 127 to connect the driven components of the system 5 located on the truck's bed 20 with the output shaft 120 of the PTO located there-below.

The PTO 45 is preferably equipped with at least one PTO clutch 125 that facilitates the selective engagement of output shaft 120 with at least the take-off assembly 121. The clutch 125 comprises any clutch understood in the art as connecting and disconnecting the output shaft 120 in relation to the take-off assembly 121, to include positive, friction, fluid or electromagnetic clutches known in the art. The clutch 125 may also comprise a common belt tightener for tightening and loosening the belt of the belt and sheave assembly 127 in relation to the output shaft 120, for engaging and disengaging the driven relationship between the two. Regardless of the type of clutch utilized, its operation may include the movement of a lever or handle or the actuation of any electronic control known in the art as actuating or de-actuating a clutch.

Figure 4A:
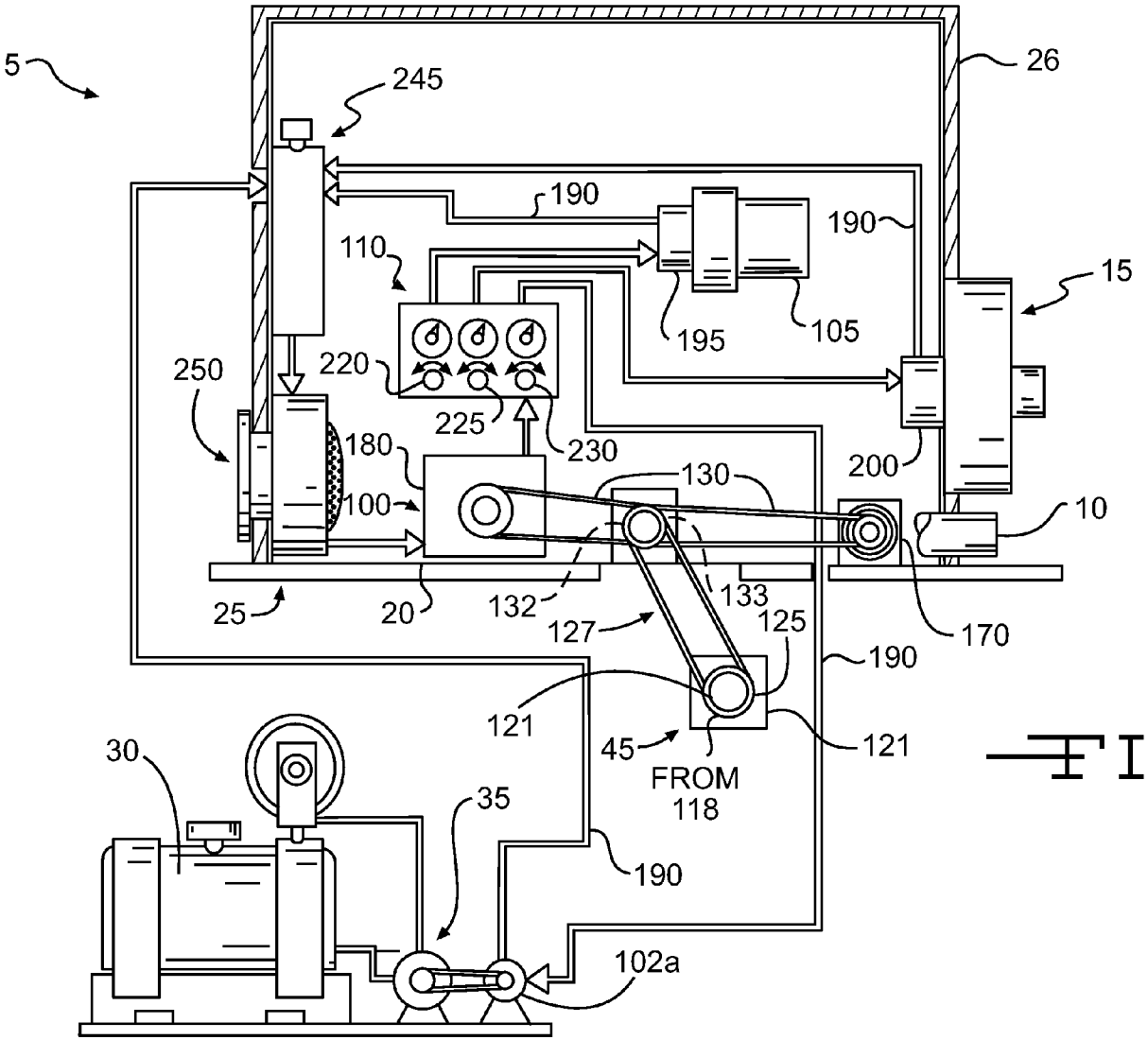
FIG. 4A is a schematic elevation view of the system of FIG. 2A deriving power from a sole power source.
Figure 4B:
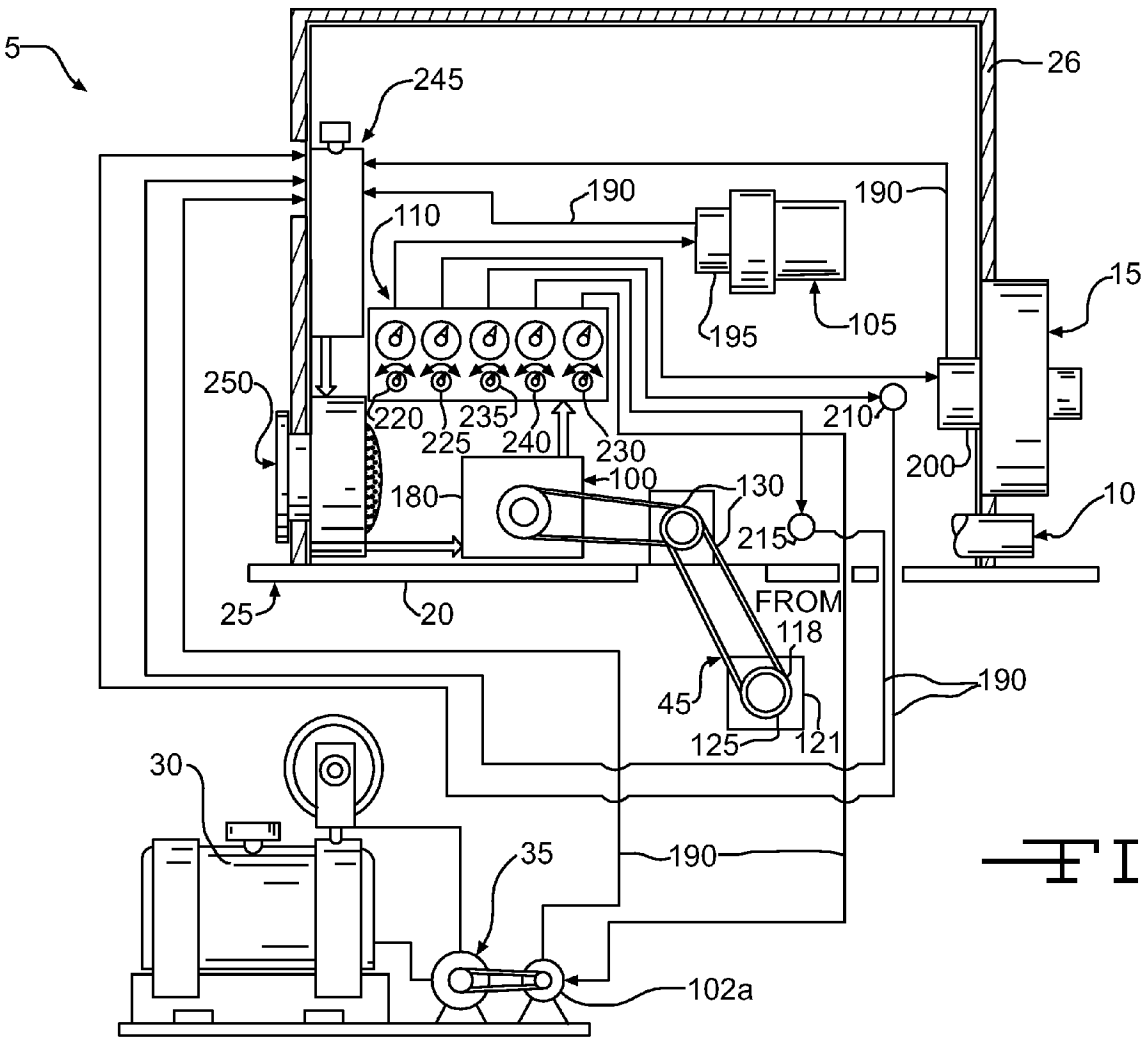
FIG. 4B is a schematic elevation view of the system of FIG. 2B deriving power from a sole power source.

FIGS. 4A and 4B are schematic diagrams of the components of FIGS. 2A and 2B, respectively, illustrating the components preferably located within the truck's box 26, as viewed from the rear with the truck's box shown in section. In the embodiment of the invention illustrated in FIG. 4A, the operable association of the insulation blower 10 and the hydraulic drive 100 with the PTO 45 preferably comprises at least one endless belt 130 driven by the belt and sheave assembly 127 of the PTO. The at least one endless belt 130 is preferably selectively driven between the PTO 45 and the hydraulic drive 100 and between the PTO and the blower power train 170 of the blower 10, to be discussed further, to enable the PTO to selectively provide rotational energy to each component. In the embodiment of the invention illustrated in FIG. 4B, operable association of the hydraulic drive 100 with the PTO 45 again preferably comprises the at least one endless belt 130 driven by the belt and sheave assembly 127 of the PTO 45, with the insulation blower 10 operably associated with the hydraulic drive and not the PTO via the hydraulic motors 210 and 215 of the blower, to be discussed further. Again, the at least one endless belt 130 is preferably selectively driven between the PTO 45 and the hydraulic drive 100 to enable the PTO to selectively provide rotational energy to the component.

As illustrated in FIGS. 4A and 4B, the selectively driven relation of the at least one endless belt 130 between the PTO 45 and the hydraulic drive 100, as well as the selectively driven relation of the at least one endless belt between the PTO and the blower power train 170, preferably comprises respective hydraulic drive and blower clutches 132 and 133 that facilitate the selective engagement of each endless belt to the belt and sheave assembly 127 of the PTO. Each clutch 132 and 133 comprises any clutch understood in the art as connecting of disconnecting the hydraulic drive 100 and/or blower power train 170 in relation to belt and sheave assembly 127 of the PTO 45, to include positive, friction, fluid or electromagnetic clutches known in the art. Each clutch 132 and 133 may also comprise a common belt tightener for tightening and loosening the respective belts 130 driving the hydraulic drive 100 and blower power train 170 in relation to the belt and sheave assembly of the PTO, for engaging and disengaging the their respective driven relationships. Regardless of the type of clutch utilized, their operation may include the movement of a lever or handle or the actuation of any electronic control known in the art as actuating or de-actuating a clutch.

Figure 5A:
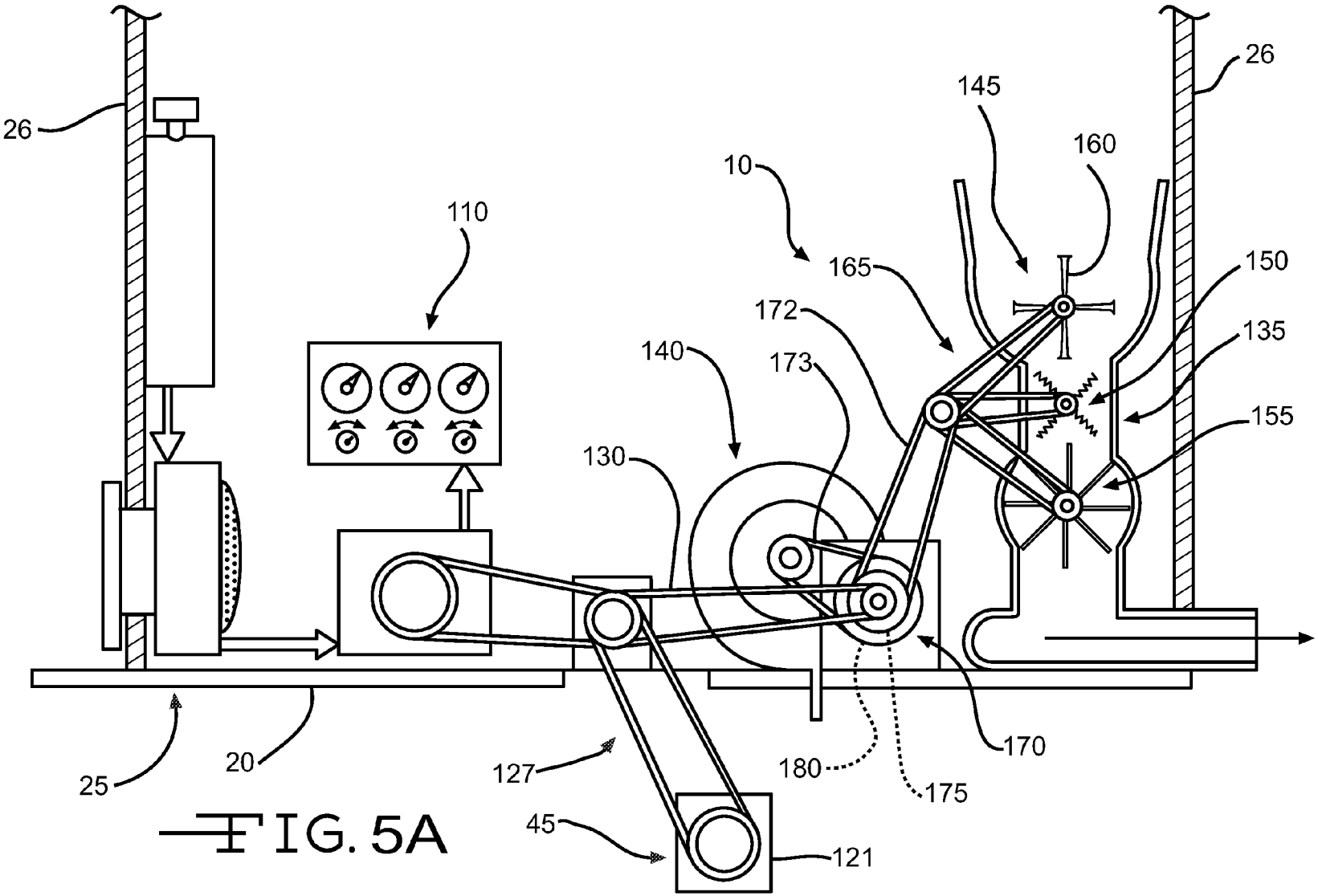
FIG. 5A is a schematic elevation view illustrating the driven relation ship of the insulation blower of FIG. 4A in greater detail.
Figure 5B:
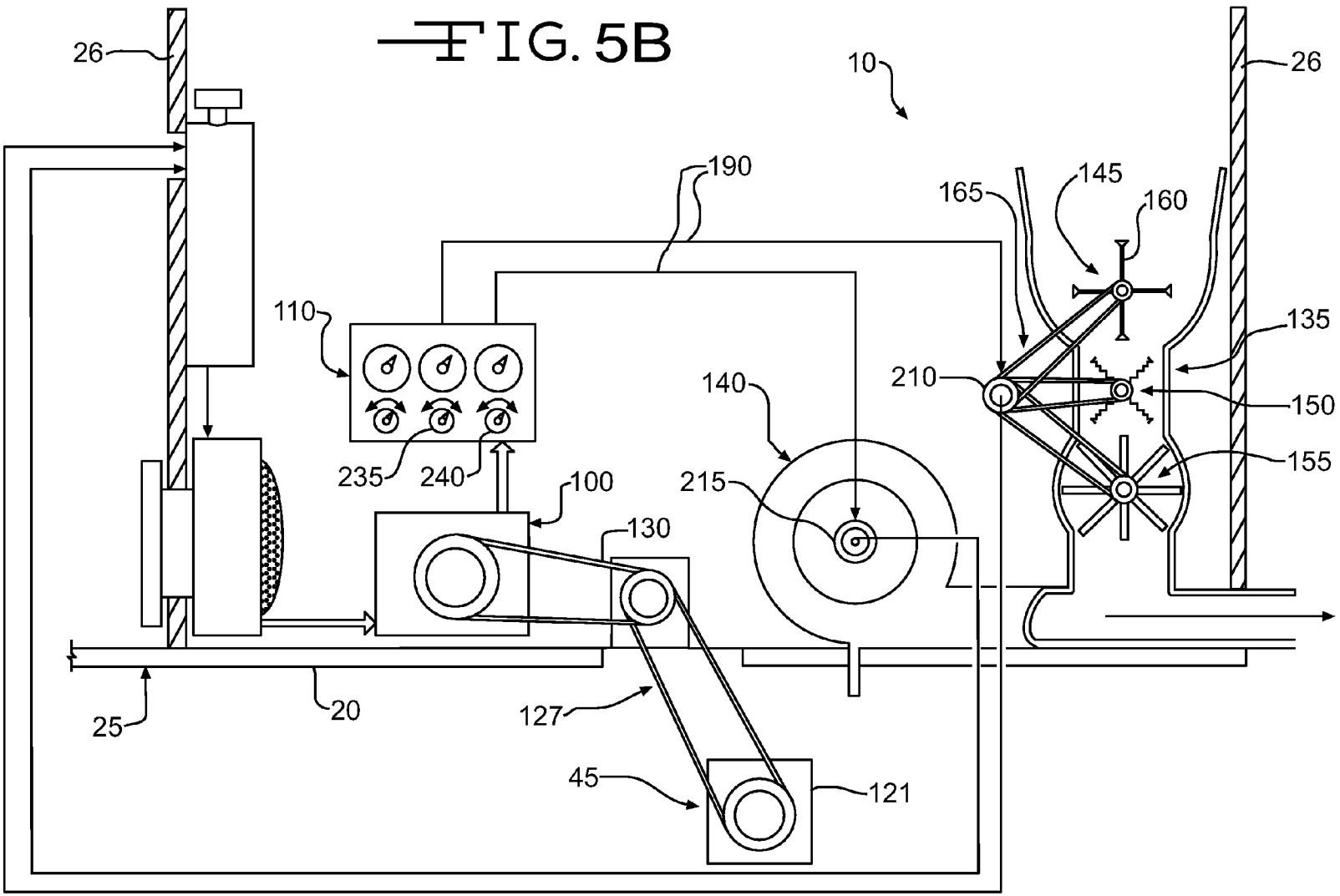
FIG. 5B is a schematic elevation view illustrating the driven relationship of the insulation blower of FIG. 4B in greater detail.

Referring to FIGS. 5A and 5B, the insulation blower 10 of the sprayed insulation application system 5 preferably includes sub-components that condition the insulation material and blow it through the hose to its application destination. The sub-components of the insulation blower 10 thus preferably comprise a conditioning unit 135 and a blower fan 140. The conditioning unit 135, which conditions the insulation material for the blower fan 140, preferably comprises at least a feeder 145, a shredder 150 and a rotary airlock 155. The feeder 145 utilizes one or more rotors 160 to break up the loose insulation fed into the hopper and feed it to the shredder 150. The shredder 150 further breaks-up the insulation and feeds it through the rotary airlock 155. Within the airlock 155, the loose, shredded insulation is combined with an air stream created by the blower fan 140 and is blown out of the blower 10 and through a hose and nozzle to its application destination. Although FIGS. 5A and 5B illustrate the conditioning unit 135 as comprising a feeder, shredder and rotary airlock, it is understood that the unit may comprise fewer or additional sub-components as well, to include fewer or additional shredders, fans, etc.

As illustrated in FIG. 5A, the feeder 145, shredder 150, and rotary airlock 155 are preferably operably associated with one another via a conditioning unit drive train 165. The conditioning unit drive train 165, preferably comprising an assembly of belts and/or chains and gears understood in the art, allows each of the sub-components of the conditioning unit 135 to be driven by a single source. Thus, for embodiments of the system 5 having an insulation blower 10 driven by the PTO 45, the PTO may independently drive the conditioning unit 135 and the blower fan 140 of the blower via the at least one belt 130 operably connecting each to the PTO.

In the embodiment of the system 5 driving the insulation blower 10 with the PTO 45 illustrated in FIG. 5A, the blower includes an insulation blower power train 170, preferably operably connected to the PTO via the at least one belt 130, to selectively transmit rotational power from the PTO to either or both the conditioning unit drive train 165 and the blower fan 140 of the blower via respective belts 172 and 173. The insulation blower power train 170 thus preferably includes at least two clutches, i.e. a conditioning unit clutch 175 and a blower fan clutch 180, that allow for the selective transmission of power from the blower power train 170, driven by the PTO 45, to the conditioning unit drive train 165 and the blower fan 140, respectively.

The utilization of the at least two clutches 175 and 180 thus allows the air stream that conveys the insulation material to its application destination to be controlled independently of the feeder 145, shredder 150 and rotary airlock 155 of the conditioning unit 135 that conditions the material and conveys it into the air stream of the blower fan 140. Each clutch 175 and 180 comprises any clutch understood in the art as connecting or disconnecting the blower fan 140 and/or conditioning unit drive train 165 in relation to the insulation blower power train 170, to again include positive, friction, fluid or electromagnetic clutches known in the art. Each clutch 175 and 180 may also comprise a common belt tightener for tightening and loosening the respective belts 172 and 173 driving the conditioning unit 135 and blower fan 140 in relation to the insulation blower power train 170, for engaging and disengaging the their respective driven relationships. Regardless of the type of clutch utilized, their operation may include the movement of a lever or handle or the actuation of any electronic control known in the art as actuating or de-actuating a clutch.

Referring again to FIGS. 4A and 4B, the hydraulic drive 100 operably associated with the PTO 45 preferably comprises a hydraulic pump 180 well known in the art that utilizes hydraulic fluid to drive the various components of the sprayed insulation application system 5 via a network of hydraulic lines 190. The connection of the hydraulic lines 190 between the hydraulic drive 100 and the system's components, to include the electrical generator 105, the vacuum fan 15 and optionally the pump 35 and insulation blower 10, allows each of these components to be located anywhere independent of the location of the output shaft 120 of the PTO 45.

In embodiments of the system 5 having the generator 105 and vacuum fan 15, and optionally the pump 35 driven by the hydraulic drive 100, as illustrated in FIG. 4A, the operable association of the generator, vacuum fan and optional pump with the hydraulic drive comprises a generator hydraulic motor 195, a vacuum fan hydraulic motor 200 and the optional pump hydraulic motor 205*a,* each in fluid communication with the hydraulic drive. For embodiments of the system 5 also having the insulation blower 10 operably associated with the hydraulic drive 100 along with the optional pump 35, as illustrated in FIG. 4B, the operable association of the blower 10 with the hydraulic drive further comprises a conditioning unit hydraulic motor 210 and a blower fan hydraulic motor 215 while the operable association of the optional pump with the hydraulic drive again comprises the pump hydraulic motor 205*a*. Each hydraulic motor 210, 215 and 205*a* is in fluid communication with the hydraulic drive 100 in addition to the generator and vacuum fan hydraulic motors 195 and 200.

Each motor receives hydraulic fluid from the hydraulic drive 100 via the hydraulic lines 130 and converts the fluid's flow into rotational energy used to drive the respective component of the insulation application system 5. Thus, for example, when the insulation blower 10 is operably associated with the hydraulic drive 100, the blower fan hydraulic motor 215 provides rotational energy to the blower fan 140 while the conditioning unit motor 210 provides rotational energy to the conditioning unit drive train 165 to drive the feeder 145, shredder 150 and rotary airlock 155 of the blower. With regard to the hydraulic drive 100, it is understood that other variations may also occur within the systems illustrated in both FIGS. 4A and 4B. For example, the lift 80 may be operably associated with the hydraulic drive 100 instead of receiving energy from the electrical generator 105, with such an operable association of the lift with the drive comprising a lift hydraulic motor or lift hydraulic actuator in fluid communication therewith.

Referring again to FIGS. 4A and 4B, at least one control 110 regulates the operable association of the generator 105, the vacuum fan 15, and optionally the pump 35 and insulation blower 10 with the hydraulic drive 100. In embodiments of the system 5 having the generator 105 and vacuum fan 15, and optionally the pump 35 driven by the hydraulic drive 100, as illustrated in FIG. 4A, the at least one control 110 preferably comprises a generator valve 220, a vacuum fan valve 225 and optionally the pump valve 230 respectively regulating the fluid communication between the hydraulic drive and the generator, vacuum fan and optional pump hydraulic motors 195, 200 and 205*a*. For embodiments of the system 5 also having the insulation blower 10 operably associated with the hydraulic drive 100 along with the optional pump 35, as illustrated in FIG. 4B, the at least one control 110 further comprises a conditioning unit valve 235 and a blower fan valve 240, while the at least one control for the optional pump again comprises the pump valve 230. Each valve 235, 240 and 230 respectively regulates the fluid communication between the hydraulic drive 100 and the respective hydraulic motors in addition to those valves regulating the fluid communication between the drive and the other hydraulic motors of the system.

As understood in the art, each valve regulates the fluid communication between the hydraulic drive 100 and each hydraulic motor of the system to thereby regulate the rotational energy received by each respective component. In regulating the fluid communication, each valve thus enables an opening and closing of the fluid-flow circuit between the hydraulic drive and each hydraulic motor to thus energize and de-energize (i.e. turn on and off) each motor accordingly, as well as a control of the rate of fluid flow within the circuit to control the rotational rate of each motor. Any type of valve may be utilized, to include globe, gate, needle or other similar valve types. Thus, for example, when the insulation blower 10 is operably associated with the hydraulic drive 100, the hydraulic blower fan valve 240 regulates the fluid communication between the drive and the blower fan hydraulic motor 215 to energize, de-energize and control the rotational rate of the blower fan while the conditioning unit valve 235 regulates the fluid communication between the drive and the conditioning unit motor 210 to energize, de-energize and control the rotational rate of the feeder 145, shredder 150 and rotary airlock 155 of the blower. Similar operations occur for the control of the other hydraulically driven components of the system Although the generator valve 220 is preferably utilized to regulate the fluid communication between the hydraulic drive 100 and the generator hydraulic motor 195, it is understood that the generator valve may be eliminated such that a constant, unregulated flow of fluid is provided to the generator hydraulic motor. Furthermore, additional valves may be utilized to accommodate for variations of the system. For example, if the lift 80 is be operably associated with the hydraulic drive 100 via a hydraulic motor or actuator instead of receiving energy from the electrical generator 105, a lift valve would be utilized to regulate the fluid communication between the drive and the motor or actuator of the lift.

Referring again to FIGS. 4A and 4B, a fluid reservoir 245 may be utilized for storing the hydraulic fluid of the system 5. The fluid reservoir 245 is preferably in fluid communication between the hydraulic drive 100 and the generator, vacuum fan, and optionally the pump, conditioning unit and blower fan hydraulic motors. A fluid cooler 250 may also be utilized to cool the hydraulic fluid of the system 5, with the cooler preferably in fluid communication between the fluid reservoir 245 and the hydraulic drive 100.

Figure 6:
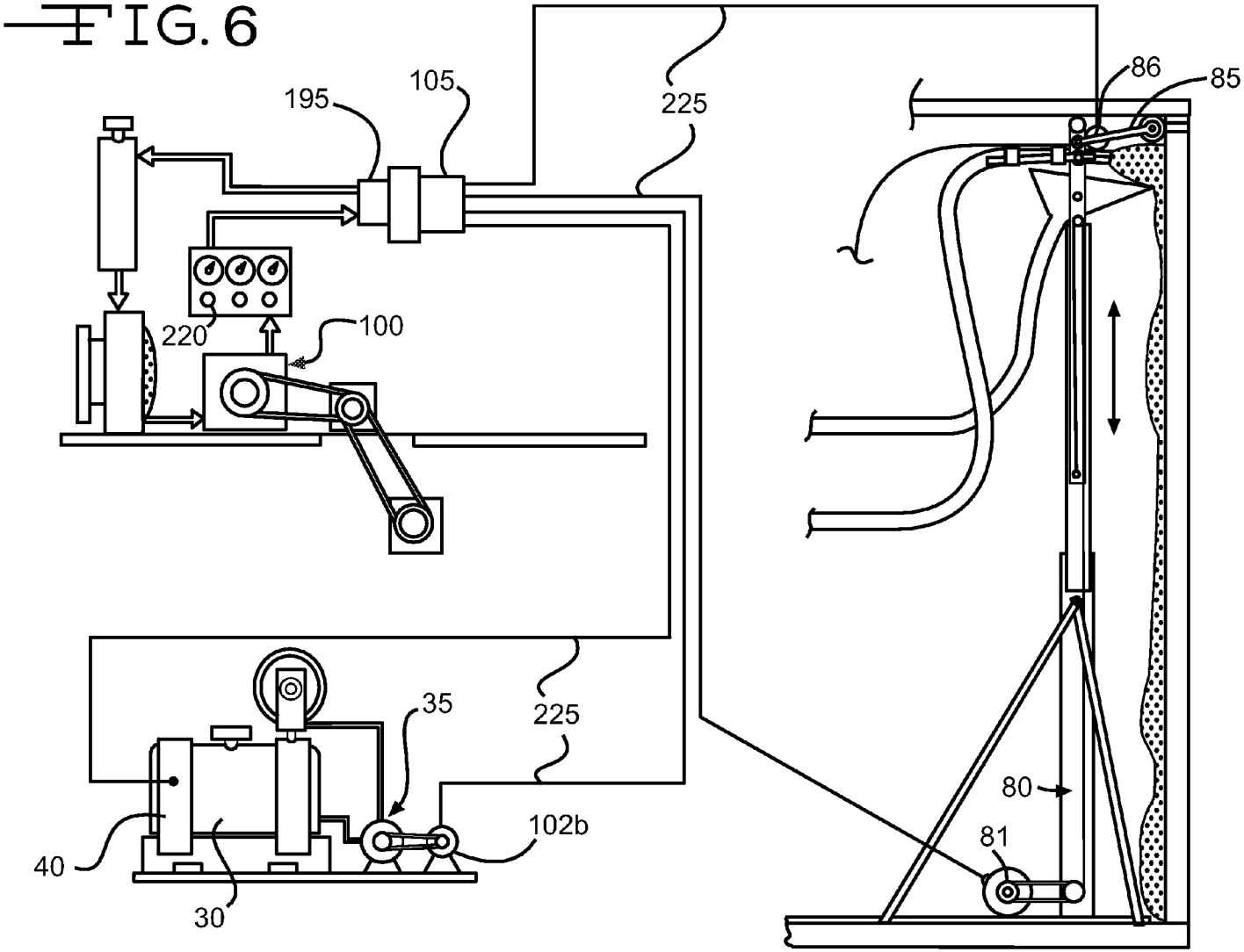
FIG. 6 is a schematic elevation view illustrating the relationship between the generator and energized components of the system.

As illustrated in FIG. 6, the electrical generator 105, driven by the generator hydraulic motor 195 in fluid communication with the hydraulic drive 100, preferably provides electrical energy to the electric scrubber motor 86 of the scrubber 85 and to the at least one liquid heater 40 of the reservoir 30 via the electrical conduit 255. The generator 100 also provides electrical energy to the motor 81 of the electrically powered lift 80, if utilized within the system 5, via the conduits 255. If the pump 35 is not operably associated with the hydraulic drive 100, the electrical generator 105 also provides electrical energy to an electric pump motor 205*b* of the pump via the electrical conduit 255. The electrical generator preferably generates 110 V of electricity for powering the foregoing electrical components of the system. It is understood that in addition to the foregoing components, the generator 105 may also provide electrical energy to various other components as well, to include various hand tools, an optional electrically driven reciprocator used to move the applicator nozzle in a side-to-side motion during the application process, and or an air compressor, etc.

In use in one embodiment of powering the sprayed insulation application system utilizing a sole power source, the at least one power-take-off is driven by the sole power source (i.e. truck engine), with the power-take-off preferably comprising an output shaft driven by a take-off assembly operably associated with the engine's transmission. The insulation blower and the hydraulic drive are driven by the at least one power-take-off via the at least one engageable belt preferably driven by the belt and sheave assembly of the power-take-off. The at least one engageable belt selectively engages the respective hydraulic drive and the insulation blower power train to the PTO to selectively provide rotational energy to each component. An actuation of the hydraulic drive and blower clutches, respectively, thus facilitates the selective engagement of each component with the PTO. The engagement of the insulation blower power train with the PTO allows for the selective transmission of power from the PTO to either or both the conditioning unit and blower fan of the blower. An actuation of the conditioning unit and blower fan clutches, respectively, thus facilitates the selective transmission of power to each component from the blower power train driven by the PTO.

With the at least one engageable belt engaging the hydraulic drive to the PTO, the drive drives the electrical generator and the vacuum fan by providing a flow of hydraulic fluid to the respective generator and vacuum fan hydraulic motors. The at least one control is utilized for controlling the generator and the vacuum fan in relation to the hydraulic drive via an adjustment of the respective generator and vacuum fan valves. If the pump of the system is driven by the hydraulic drive, the drive provides a flow of hydraulic fluid to the pump's hydraulic motor as well, with a control of the pump in relation to the hydraulic drive occurring through an adjustment of the pump valve. With the electrical generator hydraulic motor receiving hydraulic fluid from the hydraulic drive, the generator energizes the scrubber, and the at least one liquid heater and/or the electrically powered lift, if utilized within the system. If the pump of the system is associated with the generator and not the hydraulic drive, the pump is energized by the electrical generator as well.

In use in another embodiment of powering the sprayed insulation application system with a sole power source, the power-take-off is again driven by the sole power source, with the power-take-off again preferably comprising the output shaft driven by the take-off assembly operably associated with the engine's transmission. The hydraulic drive is driven by the power-take-off via the at least one engageable belt again preferably driven by the belt and sheave assembly of the power-take-off. The at least one engageable belt selectively engages only the hydraulic drive to the PTO to selectively provide rotational energy to the component. An actuation of the hydraulic drive clutch thus facilitates the selective engagement of the component with the PTO. The hydraulic drive thus drives the electrical generator, the vacuum fan and the insulation blower by providing a flow of hydraulic fluid to the respective generator, vacuum fan, conditioning unit, and blower fan hydraulic motors. The at least one control is utilized for controlling the generator, vacuum fan, conditioning unit and blower fan in relation to the hydraulic drive via an adjustment of the respective generator, vacuum fan, conditioning unit and blower fan valves. Again, if the pump of the system is driven by the hydraulic drive, the drive provides a flow of hydraulic fluid to the pump's hydraulic motor, with a control of the pump in relation to the hydraulic drive occurring through an adjustment of the pump valve.

With the electrical generator hydraulic motor receiving hydraulic fluid from the hydraulic drive, the generator again energizes the scrubber, and the at least one liquid heater and/or the electrically powered lift, if utilized within the system. If the pump of the system is associated with the generator and not the hydraulic drive, the pump is energized by the electrical generator as well. While this foregoing description and accompanying drawings are illustrative of the present invention, other variations in structure and method are possible without departing from the invention's spirit and scope.

I claim:

1. A sprayed insulation application system utilizing a sole power source comprising:

at least one power-take-off operably associated with the power source;

an insulation blower and a hydraulic drive operably associated with the at least one power-take-off;

a generator and a vacuum fan operably associated with the hydraulic drive;

at least one control regulating the operable association of the generator and the vacuum fan with the hydraulic drive; and at least one hydraulic motor in fluid communication with the hydraulic drive selected from the group consisting of a generator hydraulic motor and a vacuum fan hydraulic motor.

2. The system of claim 1 further comprising a pump energized by the generator.

3. The system of claim 1 further comprising a pump operably associated with the hydraulic drive and regulated by the at least one control.

4. The system of claim 3 further comprising a scrubber energized by the generator.

5. The system of claim 4 wherein the operable association of the generator, the vacuum fan and the pump with the hydraulic drive comprises a generator hydraulic motor, a vacuum fan hydraulic motor and a pump hydraulic motor in fluid communication with the hydraulic drive.

6. The system of claim 5 wherein the at least one control comprises a generator valve, a vacuum fan valve and a pump valve respectively regulating the fluid communication between the hydraulic drive and the generator, vacuum fan and pump hydraulic motors.

7. The system of claim 6 further comprising a fluid reservoir in fluid communication between the generator, vacuum fan and pump hydraulic motors and the hydraulic drive.

8. The system of claim 7 further comprising a fluid cooler in fluid communication between the fluid reservoir and the hydraulic drive.

9. The system of claim 6 wherein the insulation blower comprises a conditioning unit and a blower fan.

10. The system of claim 9 wherein the conditioning unit comprises at least a feeder, a shredder and a rotary airlock.

11. The system of claim 4 further comprising at least one liquid heater energized by the generator.

12. The system of claim 4 further comprising an electrically powered lift energized by the generator.

13. The system of claim 1 wherein the operable association of the insulation blower and the hydraulic drive with the power-take-off comprises at least one selectively driven endless belt.

14. A sprayed insulation application system utilizing a sole power source comprising:

a power-take-off operably associated with the power source;

a hydraulic drive operably associated with the power-take-off;

a generator, a vacuum fan and an insulation blower operably associated with the hydraulic drive;

at least one control regulating the operable association of the generator, the vacuum fan and the insulation blower with the hydraulic drive; and at least one hydraulic motor in fluid communication with the hydraulic drive selected from the group consisting of a generator hydraulic motor, a vacuum fan hydraulic motor, and a blower fan hydraulic motor.

15. The system of claim 14 further comprising a pump energized by the generator.

16. The system of claim 14 further comprising a pump operably associated with the hydraulic drive and regulated by the at least one control.

17. The system of claim 16 further comprising a scrubber energized by the generator.

18. The system of claim 17 wherein the insulation blower comprises a conditioning unit and a blower fan.

19. The system of claim 18 wherein the operable association of the generator, the vacuum fan, the pump and the insulation blower with the hydraulic drive comprises a generator hydraulic motor, a vacuum fan hydraulic motor, a pump hydraulic motor, a conditioning unit hydraulic motor and a blower fan hydraulic motor, each motor in fluid communication with the hydraulic drive.

20. The system of claim 19 wherein the at least one control comprises a generator valve, a vacuum fan valve, a pump valve, a conditioning unit valve and a blower fan valve, each valve respectively regulating the fluid communication between the hydraulic drive and the generator, vacuum fan, pump, conditioning unit and blower fan hydraulic motors.

21. The system of claim 20 further comprising a fluid reservoir in fluid communication between the generator, vacuum fan, pump, conditioning unit and blower fan hydraulic motors and the hydraulic drive.

22. The system of claim 21 further comprising a fluid cooler in fluid communication between the fluid reservoir and the hydraulic drive.

23. The system of claim 18 wherein the conditioning unit comprises at least a feeder, a shredder and a rotary airlock.

24. The system of claim 17 further comprising at least one liquid heater energized by the generator.

25. The system of claim 17 further comprising an electrically powered lift energized by the generator.

26. The system of claim 14 wherein the operable association of the hydraulic drive with the power-take-off comprises at least one selectively driven endless belt.

* * * * *